US009620308B1

(12) United States Patent
Li

(10) Patent No.: US 9,620,308 B1
(45) Date of Patent: Apr. 11, 2017

(54) MEMBRANE KEYBOARD EQUIPPED WITH CLICK GENERATING RESILIENT PIECES

(71) Applicant: Yong Li, Hunan Province (CN)

(72) Inventor: Yong Li, Hunan Province (CN)

( * ) Notice: Subject to any disclaimer, the term of this patent is extended or adjusted under 35 U.S.C. 154(b) by 0 days.

(21) Appl. No.: 15/016,281

(22) Filed: Feb. 5, 2016

(51) Int. Cl.
*H01H 13/85* (2006.01)
*H01H 13/702* (2006.01)

(52) U.S. Cl.
CPC ..... *H01H 13/85* (2013.01); *H01H 13/702* (2013.01); *H01H 2215/03* (2013.01)

(58) Field of Classification Search
CPC .. H01H 13/85; H01H 13/702; H01H 2215/03; H01H 13/26; H01H 13/03; H01H 13/04; H01H 13/70
USPC ..... 200/5 A, 341–345, 292, 516–517, 200/520–521, 308
See application file for complete search history.

(56) References Cited

U.S. PATENT DOCUMENTS 5,004,880 A * 4/1991 Koutaka ..... H01H 13/14 200/308
5,324,902 A * 6/1994 Shen ..... H01H 13/705 200/516
9,305,721 B2 * 4/2016 Izawa ..... H01H 13/023

* cited by examiner

*Primary Examiner* — Edwin A. Leon

(57) ABSTRACT

A membrane keyboard equipped with click generating resilient pieces, having multiple keys and an electrically conductive membrane; each of the keys having a base and a cap; the cap sleeves on the base; an inner sidewall of the base is provided with an insertion slot for mounting a click generating resilient piece; a top part of the insertion slot is provided with position limiting wedges; the click generating resilient piece is positioned between the inner sidewall of the base and an outer sidewall of the cap; the cap is provided with a motion transmission element which drives the click generating resilient piece to move up and down in the insertion slot when the cap moves up and down. The clicking sounds generated by the click generating resilient pieces help users determine whether the desired key is pressed or released. Obvious tactile feedback can also be felt when using the keyboard.

6 Claims, 2 Drawing Sheets

MEMBRANE KEYBOARD EQUIPPED WITH CLICK GENERATING RESILIENT PIECES

BACKGROUND OF THE INVENTION

The present invention relates to a keyboard structure, and more specifically relates to a membrane keyboard with click generating resilient pieces.

Membrane keyboard is a kind of computer peripheral device equipped with multiple keys thereon. By pressing the keys, signals or commands are input and then transmitted to the computer. Membrane keyboard is a type of keyboard commonly used nowadays. However, membrane keyboard has a disadvantage of being silent during operation of the keys by pressing them and then allowing them to reset to their original positions. Therefore, users will not have the tactile perception of striking the keys when they are using a membrane keyboard. Specifically, special use of a keyboard for example when playing computer games, quietness of the membrane keyboard will definitely reduce the fun and excitement of playing the games. Also, quietness of the keyboard will easily lead to input errors.

BRIEF SUMMARY OF THE INVENTION

In view of the aforesaid disadvantages now present in the prior art, the present invention provides a kind of membrane keyboard equipped with click generating resilient pieces. This kind of membrane keyboard is equipped with a click generating resilient piece in each of the keys. The clicking sounds may help users determine whether the desired key is pressed or released. Obvious tactile feedback can also be felt when using the keyboard.

To solve the above technical problems, the present invention provides a membrane keyboard equipped with click generating resilient pieces, comprising multiple keys; each of the keys comprises a base and a cap; the cap sleeves on the base; an inner sidewall of the base is provided with an insertion slot for mounting a click generating resilient piece; a top part of the insertion slot is provided with position limiting wedges; the click generating resilient piece is positioned between the inner sidewall of the base and an outer sidewall of the cap; the cap is provided with a motion transmission element which drives the click generating resilient piece to move up and down in the insertion slot when the cap moves up and down.

The click generating resilient piece comprises a sheet body and a bent portion; an end of the bent portion is bent downwardly to form an acute angle with respect to the bent portion and is connected to the sheet body; another end of the bent portion is bent inwardly towards the sheet body to form a chamfered edge; a point on the bent portion that starts bending to form the chamfered edge forms a contact point abutting the outer sidewall of the cap.

The motion transmission element is a protrusion positioned on the outer side wall of the cap above the contact point; the protrusion is formed in a wedge shape.

The electrically conductive membrane is a resilient membrane; when the cap is pressed downwardly, the cap presses against an electrically conductive membrane to contact with a printed circuit board (PCB) at a bottom side of the electrically conductive membrane; when the cap is released, resilience of the electrically conductive membrane resets the cap.

An inner top side of the electrically conductive membrane is provided with a protruded contact extending downwardly; the protruded contact is connected with a bottom film through an arched portion; a bottom side of the bottom film is attached to the printed circuit board (PCB).

A top part of the cap is provided with a flange extending circumferentially; outer sides of the flange are bent downwardly to form a circumferential slot which has a width wider than a wall thickness of the base.

The present invention has the following advantages: The membrane keyboard equipped with click generating resilient pieces has a click generating resilient piece in each of the keys. The clicking sounds generated by the click generating resilient pieces help users determine whether the desired key is pressed or released. Also, obvious tactile feedback can be felt when using the keyboard.

DETAILED DESCRIPTION OF THE INVENTION

The present invention is described further in detail below with reference to accompanying figures and an embodiment.

Figure 1:
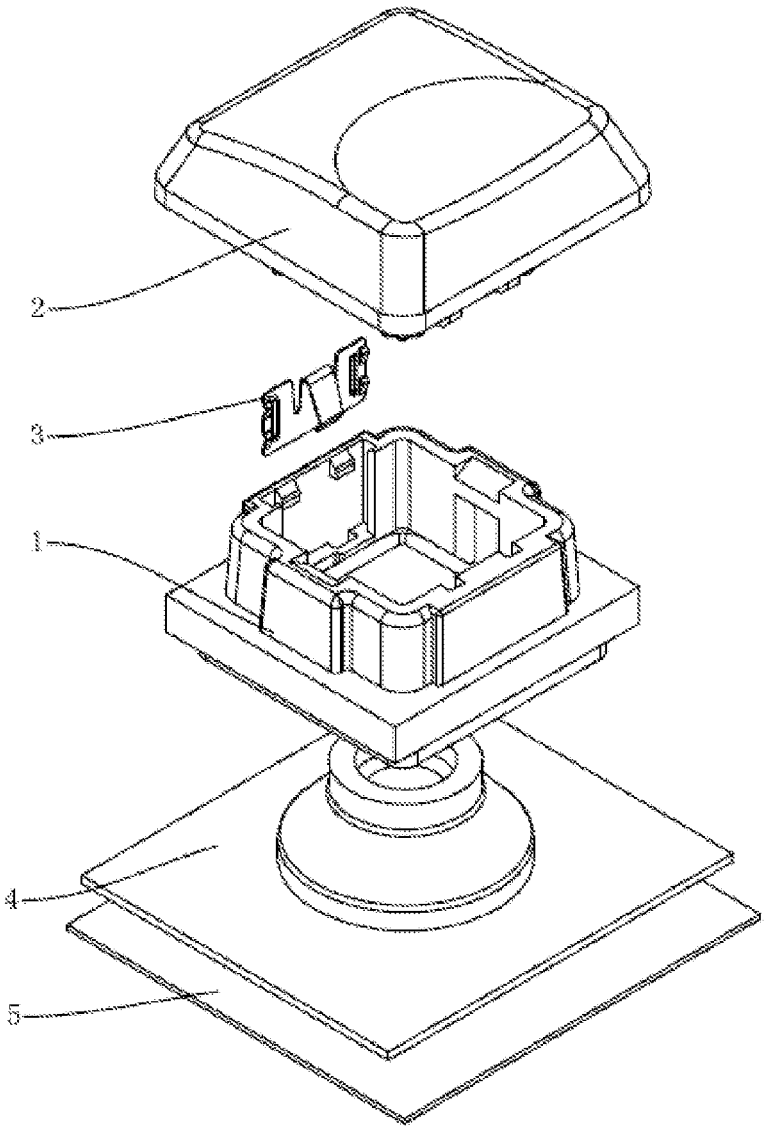
FIG. 1 is an exploded view illustrating a structure of the membrane keyboard equipped with click generating resilient pieces according to the present invention.
Figure 2:
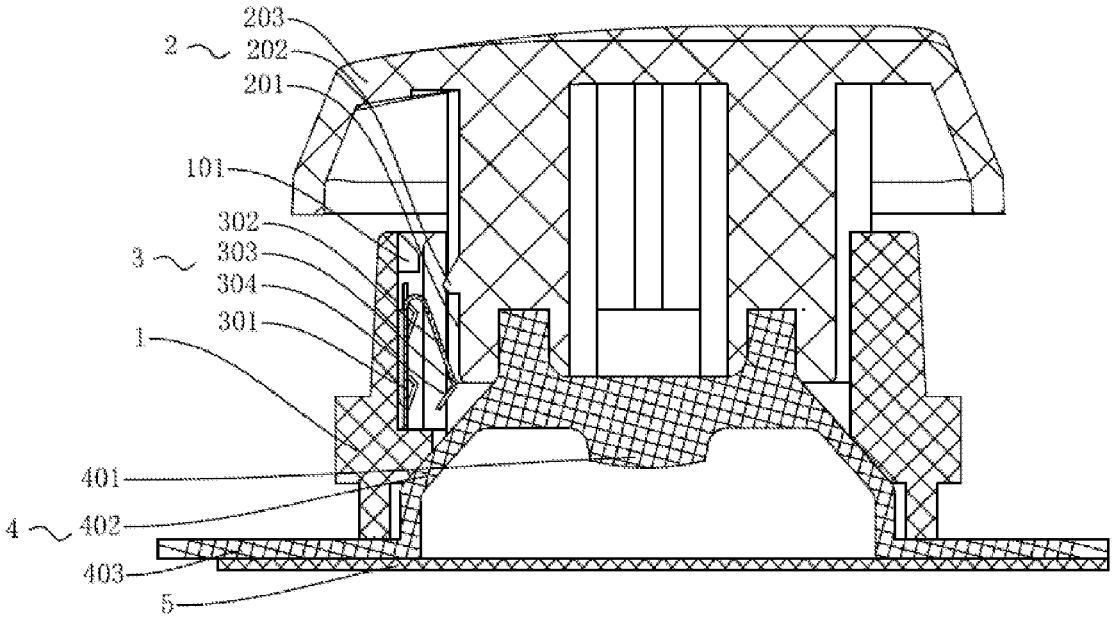
FIG. 2 is a sectional view illustrating a structure of the membrane keyboard equipped with click generating resilient pieces according to the present invention.

As shown in FIGS. 1-2, the present invention provides a membrane keyboard equipped with click generating resilient pieces, comprising multiple keys and an electrically conductive membrane. Each of the keys comprises a base 1 and a cap 2. The cap 2 sleeves on the base 1. An inner sidewall of the base 1 is provided with an insertion slot for mounting a click generating resilient piece 3. A top part of the insertion slot is provided with position limiting wedges 101. The click generating resilient piece 3 is positioned between the inner sidewall of the base 1 and an outer sidewall 201 of the cap 2. The cap 2 is provided with a motion transmission element which drives the click generating resilient piece 3 to move up and down in the insertion slot when the cap 2 moves up and down, thereby creating clicking sounds when the click generating resilient piece 3 hits against the top part and a bottom part of the insertion slot and also the motion transmission element. Therefore, it can be determined whether the key is being pressed or released. Obvious tactile feedback can also be felt.

In the above embodiment, the click generating resilient piece 3 comprises a sheet body 301 and a bent portion 302. An end of the bent portion 302 is bent downwardly to form an acute angle with respect to the bent portion 302 and is connected to the sheet body 301; another end of the bent portion 302 is bent inwardly towards the sheet body 301 to form a chamfered edge 304. A point on the bent portion 302 that starts bending to form the chamfered edge 304 forms a contact point 303 abutting the outer sidewall 201 of the cap 2. The motion transmission element is a protrusion 202 positioned on the outer side wall 201 of the cap 2 above the contact point 303. The protrusion 202 is formed in a wedge shape. As such, when the cap 2 is pressed downwardly, the protrusion 202 on the cap 2 contacts with the contact point 303 of the click generating resilient piece 3, such that the click generating resilient piece 3 generates an upward moving force and hits against the position limiting wedges 101 on the top part of the insertion slot of the base and also the protrusion 202 on the cap 2 to create a clicking sound. When the cap 2 is released, resilience of the electrically conductive membrane 4 resets the cap 2 to move upwardly, and the protrusion 202 on the cap 2 contacts with the contact point 303 of the click generating resilient piece 3 again, such that the click generating resilient piece 3 generates a downward moving force and hits against a bottom part of the insertion slot of the base 1 and also the protrusion 202 on the cap 2 to create a clicking sound. Accordingly, the clicking sounds help users determine whether the desired key is pressed or released. Obvious tactile feedback can also be felt when using the keyboard. It should be noted that the electrically conductive membrane 4 is a resilient membrane so that the electrically conductive membrane 4 has better resilience for resetting the position of the key. An inner top side of the electrically conductive membrane 4 is provided with a protruded contact 401 extending downwardly. The protruded contact 401 is connected with a bottom film 403 through an arched portion 402. A bottom side of the bottom film 403 is attached to a printed circuit board (PCB) 5. When the cap 2 is pressed downwardly, the cap 2 presses against the electrically conductive membrane 4 so that the protruded contact 401 contacts with the PCB 5 to electrically signal a press of the key.

In the above embodiment, a top part of the cap 2 is provided with a flange 203 extending circumferentially. Outer sides of the flange 203 are bent downwardly to form a circumferential slot which has a width wider than a wall thickness of the base 1 to prevent damage or jamming of the key when the key is pressed with unduly great force.

The above description is intended to describe a preferred embodiment of the present invention, but not intended to limit the present invention. Changes and modifications are allowed within the technical concept of the present invention. Therefore, any attempts of modifications and changes or use of equivalent alternatives in accordance with the above disclosure by any person skilled in this field of art should fall within the scope of protection of the present invention.

What is claimed is:

1. A membrane keyboard equipped with click generating resilient pieces, comprising multiple keys and an electrically conductive membrane; wherein each of the keys comprises a base and a cap; the cap sleeves on the base; an inner sidewall of the base is provided with an insertion slot for mounting a click generating resilient piece; a top part of the insertion slot is provided with position limiting wedges; the click generating resilient piece is positioned between the inner sidewall of the base and an outer sidewall of the cap; the cap is provided with a motion transmission element which drives the click generating resilient piece to move up and down in the insertion slot when the cap moves up and down.

2. The membrane keyboard equipped with click generating resilient pieces as claimed in claim 1, wherein the click generating resilient piece comprises a sheet body and a bent portion; an end of the bent portion is bent downwardly to form an acute angle with respect to the bent portion and is connected to the sheet body; another end of the bent portion is bent inwardly towards the sheet body to form a chamfered edge; a point on the bent portion that starts bending to form the chamfered edge forms a contact point abutting the outer sidewall of the cap.

3. The membrane keyboard equipped with click generating resilient pieces as in claim 2, wherein the motion transmission element is a protrusion positioned on the outer sidewall of the cap above the contact point; the protrusion is formed in a wedge shape.

4. The membrane keyboard equipped with click generating resilient pieces as claimed in claim 3, wherein the electrically conductive membrane is a resilient membrane; when the cap is pressed downwardly, the cap presses against the electrically conductive membrane to contact with a printed circuit board (PCB) at a bottom side of the electrically conductive membrane; when the cap is released, resilience of the electrically conductive membrane resets the cap.

5. The membrane keyboard equipped with click generating resilient pieces as claimed in claim 4, wherein an inner top side of the electrically conductive membrane is provided with a protruded contact extending downwardly; the protruded contact is connected with a bottom film through an arched portion; a bottom side of the bottom film is attached to the printed circuit board (PCB).

6. The membrane keyboard equipped with click generating resilient pieces as claimed in claim 5, wherein a top part of the cap is provided with a flange extending circumferentially; outer sides of the flange are bent downwardly to form a circumferential slot which has a width wider than a wall thickness of the base.

* * * * *